United States Patent [19]

Takasaki

[11] 3,989,098

[45] Nov. 2, 1976

[54] BUILT-IN COMBINATION COOLING AND HEATING DEVICE

[76] Inventor: Heishi Takasaki, Fujinosaki-Danchi, 1-44-202, 3486 Honmachida, Machida, Tokyo, Japan

[22] Filed: May 5, 1975

[21] Appl. No.: 574,440

[52] U.S. Cl. ..... 165/48; 98/31; 62/DIG. 16; 237/69

[51] Int. Cl.[2] ..... F25B 29/00

[58] Field of Search ..... 165/48; 62/DIG. 16; 98/31, 33 R; 237/69

[56] References Cited

UNITED STATES PATENTS

| | | | |
|---|---|---|---|
| 1,693,856 | 12/1928 | Moone | 165/48 |
| 2,107,523 | 2/1938 | Coe | 98/31 |
| 2,437,417 | 3/1948 | Bookman | 98/31 |
| 2,465,184 | 3/1949 | Alderman | 98/31 |
| 2,641,449 | 6/1953 | Antony | 98/31 |
| 3,049,067 | 8/1962 | Claude | 98/31 |
| 3,223,018 | 12/1965 | Tucker, Sr. | 98/33 R |

*Primary Examiner*—Albert W. Davis, Jr.
*Assistant Examiner*—James D. Liles
*Attorney, Agent, or Firm*—Hammond & Littell

[57] ABSTRACT

A built-in combination cooling and heating device for a residential building comprising peripheral wall members, a floor member and a ceiling member which are high thermally conductive and define a room of said residential building, an outer jacket surrounding said room defining members in a peripherally spaced relationship to the members to define an annular air space therebetween and having a hole in the center of the funnel-shaped lower end portion and the conical upper end portion provided with exhaust ports, a heater disposed in said center hole of the outer jacket lower end portion, a tunnel provided below said floor in communication with said center hole, a porous heat radiation plate suspended from said floor member right above said heater, a cooler suspended from the center of said upper end portion of the outer jacket, a porous cooling air dispersion plate suspended from said upper end portion of the outer jacket and a ventilator provided in the attic defined between the roof of said building and upper end portion of said outer jacket.

3 Claims, 4 Drawing Figures

BUILT-IN COMBINATION COOLING AND HEATING DEVICE

BACKGROUND OF THE INVENTION

This invention relates to a combination cooling and heating device for use in a residential building and more particularly, to a built-in combination cooling and heating device for use in a residential building comprising a heater and a cooler which are alternately operated.

There have been proposed and practically employed a great variety of heating and cooling devices for use in residential buildings. As most traditional and common heating devices, heating devices such as "Pechka" and "Korean stove" have been long used. Such a conventional heating device comprises a combustion kiln which is provided adjacent to one of the walls of a room to be heated and in which fuel is burnt and a zigzag combustion gas passage which is formed in the wall and in communication with a smoke stack so that the room is heated from the floor or wall surfaces of the room.

However, such a conventional heating device requires a long time and a great amount of fuel before the room where the device is provided is sufficiently heated though the device has a satisfactory warm-keeping effect once the device is ignited. And the conventional heating device fails to exhibit a satisfactory heat efficiency when employed in a multi-storey building or the like because the heating device is formed of refractory bricks and clay and thus, is not suitable for use in the multi-storey building.

In order to eliminate the disadvantages of the prior art heating device referred to above, the combination and heating device as shown in U.S. Pat. No. 3,049,067 has been proposed and the device of this U.S. patent is designed to cool or heat a portion of air and circulate the cooled or heated air within a room or rooms in a residential building. However, since this type of device is designed to send air directly into the room or rooms, when the device is operated for the purpose of heating the room or rooms, for example, it is difficult to maintain the temperature within the room or rooms uniform because the areas adjacent to the air blowing port and ceiling are more intensively heated and the areas adjacent to the floor are heated to a lesser degree. And the device of this U.S. patent is designed to forcibly circulate air under high pressure, the device will give uncomfortableness to the occupants in the room or rooms.

SUMMARY OF THE INVENTION

Therefore, the present invention is to provide a novel and improved built-in combination cooling and heating device which eliminates the disadvantages of the prior art devices referred to above.

According to the present invention, the built-in combination cooling and heating device is featured that an outer jacket is built in a room of a residential building surrounding the ceiling, walls and floor of the room in a peripherally spaced relationship thereto to define an air space therebetween for circulation of cooling or heating air therethrough. For the purpose of cooling the room, cooled air is circulated through the air space from above to below and for the purpose of heating the room, heated air is circulated through the air space from below to above. The combination cooling and heating device consumes a relatively smaller amount of energy as compared with the conventional devices having the same capacity to enhance economical effects and gives comfortableness to the occupants in the room.

According to the present invention, there has been provided a built-in combination cooling and heating device for a residential building comprising a ceiling member, wall members and a floor member which define a room of said residential building and are formed of high heat transfer rate material, an adiabatic outer jacket surrounding said ceiling, wall and floor members in a peripherally spaced relationship thereto to define an air space therebetween and having the upper end portion projecting above said ceiling member and provided with exhaust ports and the lower end portion projecting below said floor member, a heater disposed within said lower end portion of the outer jacket, an air supply tunnel provided below said floor member in communication at the opposite ends with said lower end portion of the outer jacket and an external air supply source, a porous heat radiation plate suspended from said floor member right above said heater, a cooler suspended from said upper end portion of the outer jacket, a porous cooling air dispersion plate suspended from said upper end portion of the outer jacket and positioned right below said cooler and a ventilator provided in the attic defined between the roof of said residential building and said upper end portion of the outer jacket, whereby when said heater is operated, heated air is circulated through said air space from below to above to heat the room and when said cooler is operated, cooled air is circulated through said air space from above to below to cool the room.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any.

PREFERRED EMBODIMENT OF THE INVENTION

Figure 1:
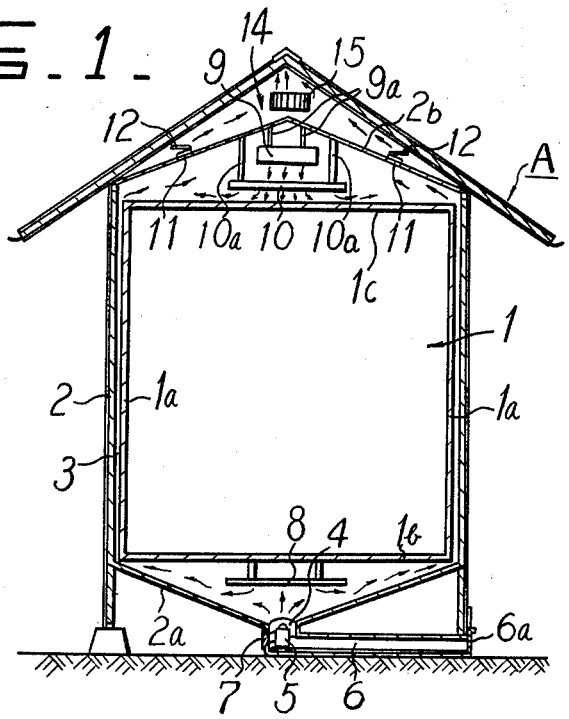
FIG. 1 is a vertically sectional view of one preferred embodiment of built-in combination cooling and heating device constructed in accordance with the present invention.

This invention will be now described referring to the accompanying drawings and more particularly, to FIG. 1 thereof which show one preferred embodiment of built-in combination cooling and heating device for a residential building of the invention. In FIG. 1, character reference A generally denotes a residential building in which at least one space 1 which serves as a room is defined. The room 1 is defined by the side wall members 1*a*, the floor member 1*b* and ceiling member 1*c* which are formed of a material of high thermal conductivity and high heat transfer rate such as iron or aluminum. An outer jacket 2 formed of an adiabatic material surrounds the entire outer periphery of the room 1 in a peripherally spaced relationship to the side wall members 1*a*, floor member 1*b* and ceiling member 1*c* to define an air space 3 therebetween and through the space 3 cooling or heating air is allowed to circulate freely.

The lower end portion 2*a* of the outer jacket 2 has a funnel shape with a downwardly directed cylindrical portion 4 in which a suitable heater 5 is disposed. The cylindrical portion 4 is communicated at the lower end with an air supply tunnel 6 which is defined by a conduit disposed below the funnel-shaped lower end portion 2*a* of the outer jacket 2 and extends in parallel to the floor member 1*b* and ceiling member 1*c* of the room 1. The other or outer end of the tunnel 6 has a shutter 6*a* detachably attached thereto. When the heater 5 is a combustion type heater, the shutter 6*a* is removed from the tonnel 6 to freely communicate the tunnel 6 with an external air source (not shown). In FIG. 1, reference numeral 7 denotes an access opening provided in the wall of the cylindrical portion 4 of the outer jacket 2 through which the heater 5 can be taken out of and reinstated into the cylindrical portion 4.

The heater 5 may be a stove, for example, which employs as its heating source city gas, propane gas, kerosene or electric current or alternatively, the heater may be a briquette-fueled brazier without departing from the scope of the invention.

Figure 2:
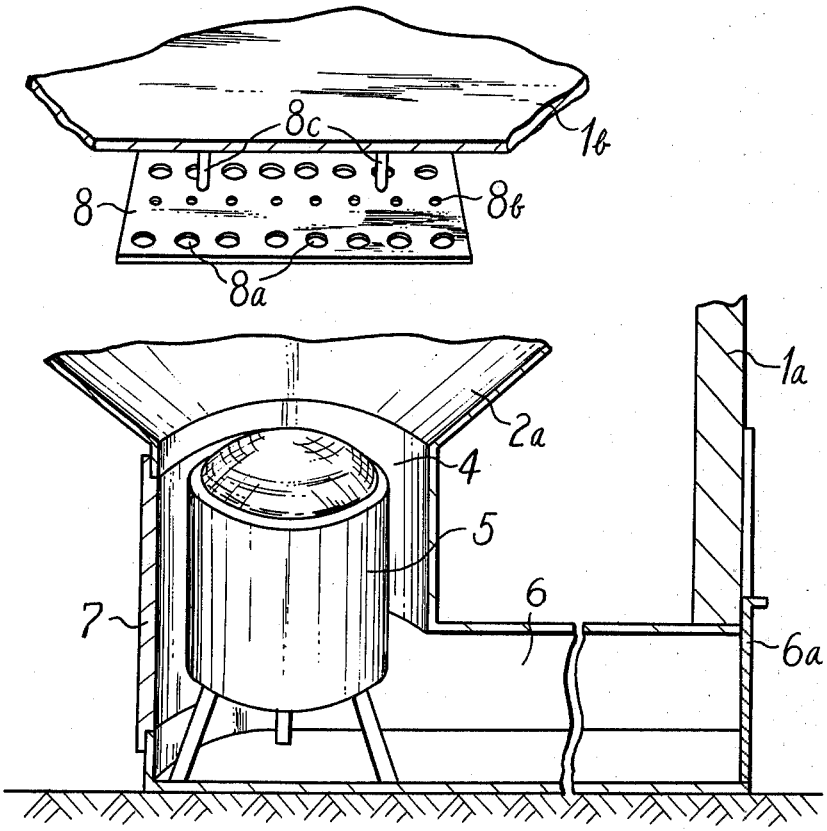
FIG. 2 is a fragmentary isometric perspective view in section on an enlarged scale of said combination cooling and heating device of FIG. 1 showing the heater and its associated parts.
Figure 3:
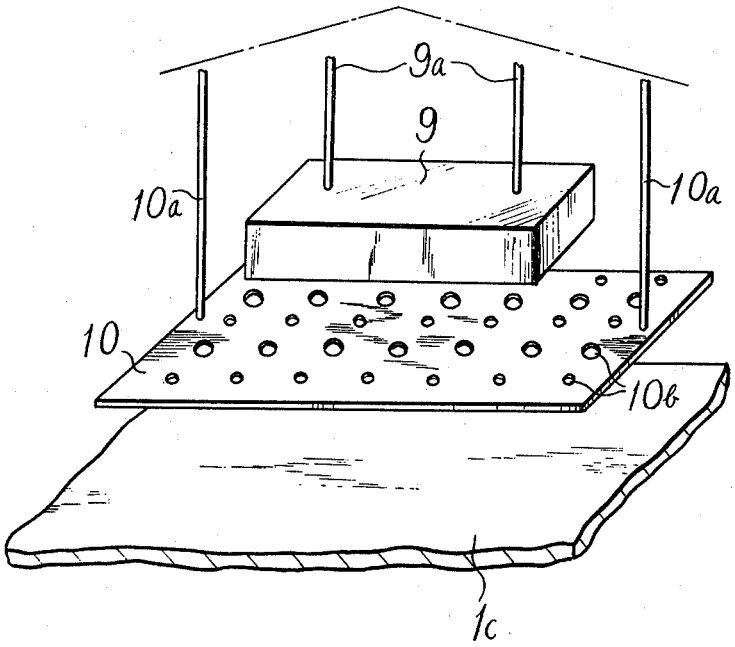
FIG. 3 is a fragmentary isometric perspective view on an enlarged scale of said combination cooling and heating device of FIG. 1 showing the cooler and its associated parts.
Figure 4:
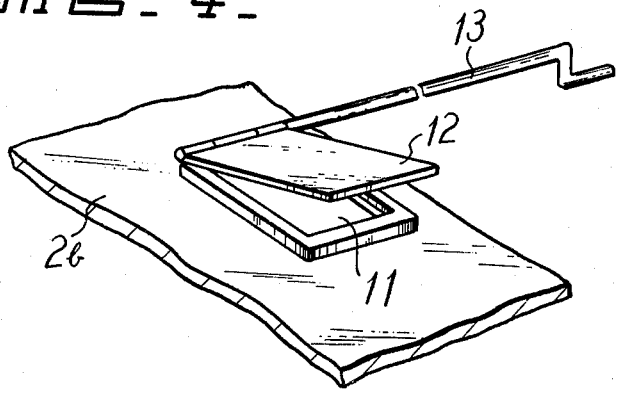
FIG. 4 is a fragmentary isometric perspective view on an enlarged scale of one of exhaust ports provided in said combination cooling and heating device of FIG. 1.

Disposed right above and upwardly spaced from the heater 5 is a porous heat radiation plate 8 which is suspended from the underside of the floor 1*b* of the room 1 and the radiation plate is formed of a relatively thick cast iron plate having series of larger and smaller through holes 8*a*, 8*a* . . . and 8*b*, 8*b* . . . arranged in alternate rows as more clearly shown in FIG. 2. However, the shape, size, number and arrangement of the through holes may be varied as desired without departing from the scope of the invention.

The upper end portion 2*b* of the outer jacket 2 is formed with a conical shape and the apex of the conical shape directs upwardly. A cooler 9 is suspended from the apex of the conical shape or the center of the upper end portion of the outer jacket 2 by means of pillars 9*a* and the cooler may be an electrical freezer. A porous cooling air dispersion plate 10 is also suspended from the conical upper end portion of the outer jacket 2 by means of pillars 10*a* which are disposed outwardly of the pillars 9*a* by which the cooler 9 is suspended and the cooling air dispersion plate is positioned right below the cooler 9. The cooling air dispersion plate 10 may be a relatively thick cast iron having a plurality of through holes 10*b* having different sizes arranged in any desired manner so as to enhance endothermic efficiency of the device of the invention.

The conical upper end portion 2*b* of the outer jacket 2 is provided with exhaust ports 11 and 11 on the opposite sides of the apex of the conical shape and opened and closed by their associated shutters 12 and 12 pivoted to the ports by means of manual handles 13 as seen in FIG. 2. When the built-in combination cooling and heating device of the invention is operated for the purpose of heating the room 1, the exhaust ports 11, 11 are left open. The outer ends of the manual handles 13 (not shown) extend out of the residential building to be externally operated. The exhaust ports 11 open into the space defined between the ceiling member 1*c* of the room 1 and the conical upper end portion 2*b* of the outer jacket 2 on one hand and into the space or attic 14 defined between the jacket upper end portion 2 and the roof of the residential building on the other hand. A suitable ventilator 15 is provided in the wall of the attic 14 through which used heating gases can be discharged.

Although not shown, in order to cool or heat the room 1 by the operation of the built-in combination cooling and heating device of the invention, a thermostat may be provided in a suitable position on one of the walls of the room 1 so that either the cooler 9 or heater 5 can be automatically operated or stopped depending upon the prevailing temperature within the room 1 whereby the room temperature can be automatically adjusted.

With the above construction and arrangement of the built-in combination cooling and heating device of the invention as referred to above, when the device is operated for heating the room 1, both the ventilator 15 in the attic 14 and the exhaust ports 11 and 11 in the outer jacket 2 are manually opened. Simultaneously, the shutter 6*a* is opened to expose the tunnel 6 to the external air supply source. Thereafter, the heater 5 is actuated in the conventional manner whereupon the heater heats the air from the tunnel 6 and the heated air first passes through the holes 8*a*, 8*b* in the radiation plate 8 to heat the plate and then flows along the underside of the floor member 1*b* of the room 1 while heating the floor into the air space 3 defined by the wall members 1*a* of the room 1 and the outer jacket 2. After having passed through the space 3, the heated air flows through the space defined between the ceiling member 1*c* of the room 1 and the upper end portion 2*b* of the outer jacket 2 and the exhaust ports 11, 11 in the outer jacket 2 into the attic 14 and discharges through the ventilator 15.

Thus it will be understood that the gaseous fluid comprising the heated gas generated from the combution of the fuel in the heater 5 and the air heated by the heater first heats the radiation plate 8 which in turn heats the surrounding air and at the same time, equally disperses the fluid to uniformly heat the underside of the floor member 1*b* of the room 1 and the heated gaseous fluid then passes upwardly through the air space 3 while progressively heating the wall members 1*a* from below to above to thereby distribute heat throughout the entire interior of the room 1.

On the other hand, when the built-in combination cooling and heating device is operated for the purpose of cooling the room 1, the cooler 9 is operated with the exhaust ports 11, 11 closed. Then, the air within the space defined by the ceiling member 1*c* of the room 1 and the upper end portion 2*b* of the outer jacket 2 is cooled by the cooler 9 and the cooled air first cools the cooling air dispersion plate 10 which in turn cools the air surrounding the plate 10 and at the same time, the cooled air from the cooler 9 itself is dispersed over the ceiling member 1*c* of the room 1 to uniformly cool the plate 10. The cooled air flow then passes down through the air space 3 to progressively cool the wall members 1*a* from above to below into the tunnel 6 to be discharged out of the room 1. In this way, the built-in combination cooling and heating device of the invention is operated for cooling the room 1, the ceiling member 1*c* of the room is cooled most intensively and the wall members 1*a* are cooled with less intensity to thereby cool the entire of the room 1. Therefore, by the employment of the combination cooling and heating device of the invention, the room can be heated by operating the heater 5 during cold months and cooled by operating the cooler 9 during hot months.

As mentioned hereinabove, according to the present invention, the peripheral wall, floor and ceiling members formed of high heat transfer rate material such as aluminum or iron and defining the room of the residential building are surrounded by the adiabatic material outer jacket in a peripherally spaced relationship to define the air space therebetween. Heated air or cooled air is passed through the air space downwardly or upwardly to cool or heat the room by dispersing or absorbing heat through the high heat transfer rate peripheral wall members. When the combination cooling and heating device of the invention is operated for the purpose heating the room, the heater provided at the bottom of the jacket is operated to heat the surrounding air and at the same time, emits heated gas through the combustion of fuel therein. The combined gaseous flow passes along the underside of the floor member 1*b* into the space 3 and rises up through the space into the space defined between the ceiling member and upper end portion of the outer jacket from where the gaseous flow is discharged via the exhaust ports into the attic and thereafter, the gaseous flow is finally discharged out of the building via the ventilator. As the heated gaseous flow passes upwardly through the air space 3 in the manner mentioned hereinabove, the heated gaseous flow progressively heats the wall members from below to above without requiring forced circulation of air by a conventional fan as conventionally required to thereby improve comfortableness in living in the room. And since the heated gaseous flow rises uniformly through the space between the peripheral wall members and the outer jacket, there will be no temperature difference to take place in any area to thereby ensure uniform heating within the room.

When the built-in combination cooling and heating device of the invention is employed for the purpose of cooling the room, the cooler is operated to cool the surrounding air and the cold air first flows along the ceiling member into the space 3 between the peripheral wall members and outer jacket where the cold air flows downwardly through the space to progressively cool the peripheral wall members from above to below in the opposite direction from that in the case of heating to thereby uniformly cool the peripheral wall members to ensure a satisfactory cooling to give comfortable living conditions to the occupant or occupants in the residential building.

Furthermore, according to the present invention, since the cooling air dispersion plate is positioned below the cooler and the heated air radiation plate is positioned below the heater, respectively, the ceiling member is uniformly cooled and the floor member is uniformly heated with high thermal efficiency.

In the foregoing, description has been made of only one embodiment of the invention, but it will readily occure to those skilled in the art that the same is illustrative in nature, but does not limit the scope of the invention in any way. The scope of the invention is only limited by the appended claims.

What is claimed is:

1. A built-in combination cooling and heating device for a residential building comprising a ceiling member, wall members and a floor member which define a room of said residential building and are formed of high heat transfer material, an adiabatic outer jacket surrounding said ceiling, wall and floor members in a peripherally spaced relationship thereto to define an air space therebetween and having the upper end portion projecting above said ceiling member and provided with exhaust ports and the lower end portion projecting below said floor member, a heater disposed within said lower end portion of the outer jacket, an air supply tunnel provided below said floor member in communication at the opposite ends with said lower end portion of the outer jacket and an external air supply source, a porous heat radiation plate suspended from said floor member right above said heater, a cooler suspended from said upper end portion of the outer jacket, a porous cooling air dispersion plate suspended from said upper end portion of the outer jacket and positioned right below said cooler and a ventilator provided in the attic defined between the roof of said residential building and said upper end portion of the outer jacket, whereby when said heater is operated, heated air is circulated through said air space from below to above to heat the room and when said cooler is operated, cooled air is circulated through said air space from above to down to cool the room.

2. The built-in combination cooling and heating device as set forth in claim 1, in which said ceiling, wall and floor members defining the room are formed of metal material member and said upper end portion of the outer jacket has a conical shape with the apex directing upwardly and said lower end portion of the outer jacket has a funnel shape provided with a downwardly extending cylindrical portion in which said heater is disposed.

3. The built-in combination cooling and heating device as set forth in claim 1, in which said heat radiation and cooling air dispersion plates are relatively thick cast iron plates.

* * * * *